US011344175B2

(12) United States Patent
Mallory et al.

(10) Patent No.: US 11,344,175 B2
(45) Date of Patent: May 31, 2022

(54) CLEANING PRODUCT WITH LOW LINT AND HIGH FLUID ABSORBENCY AND RELEASE PROPERTIES

(71) Applicant: Kimberly-Clark Worldwide, Inc., Neenah, WI (US)

(72) Inventors: Mary F. Mallory, Atlanta, GA (US); Joseph K. Baker, Cumming, GA (US); Ning Yang, Suwanee, GA (US); David M. Jackson, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 138 days.

(21) Appl. No.: 16/082,783

(22) PCT Filed: Apr. 4, 2016

(86) PCT No.: PCT/US2016/025845
§ 371 (c)(1),
(2) Date: Sep. 6, 2018

(87) PCT Pub. No.: WO2017/176238
PCT Pub. Date: Oct. 12, 2017

(65) Prior Publication Data
US 2019/0008354 A1 Jan. 10, 2019

(51) Int. Cl.
*A47L 13/17* (2006.01)
*D04H 1/732* (2012.01)
(Continued)

(52) U.S. Cl.
CPC ..... *A47L 13/17* (2013.01); *A47L 13/16* (2013.01); *D04H 1/4258* (2013.01);
(Continued)

(58) Field of Classification Search
None
See application file for complete search history.

(56) References Cited

U.S. PATENT DOCUMENTS 4,755,421 A 7/1988 Manning et al.
5,580,442 A 12/1996 Kwon et al.
(Continued)

FOREIGN PATENT DOCUMENTS

JP 10158968 6/1998

OTHER PUBLICATIONS

International Search Report and Written Opinion for PCT/US2016/025845 dated Jan. 3, 2017, 13 pages.
(Continued)

*Primary Examiner* — Shawn Mckinnon
(74) *Attorney, Agent, or Firm* — Dority & Manning, P.A.

(57) ABSTRACT

The present disclosure is directed to a wiping product well suited to absorbing a solvent and releasing the solvent onto an adjacent surface. The wiping product can also be constructed so as to have excellent abrasion resistance. The wiping product can be used in numerous applications and is particularly well suited for wiping unfinished surfaces, such as metal surfaces and composite surfaces for removing contaminants, such as oil and grease. The wiping product is made from a hydroentangled and thermally bonded web containing staple fibers and conjugated fibers.

21 Claims, 3 Drawing Sheets

(51) Int. Cl.

| | |
|---|---|
| ***D04H 1/435*** | (2012.01) |
| ***D04H 1/4258*** | (2012.01) |
| ***D04H 1/541*** | (2012.01) |
| ***D04H 13/00*** | (2006.01) |
| ***A47L 13/16*** | (2006.01) |

(52) U.S. Cl.
CPC ..... *D04H 1/435* (2013.01); *D04H 1/5412* (2020.05); *D04H 1/5418* (2020.05); *D04H 1/732* (2013.01); *D04H 13/00* (2013.01); *D10B 2201/22* (2013.01); *D10B 2331/04* (2013.01)

(56) References Cited

U.S. PATENT DOCUMENTS

| | | | | |
|---|---|---|---|---|
| 5,801,107 | A | 9/1998 | Everhart et al. | |
| 5,962,112 | A | 10/1999 | Haynes et al. | |
| 7,779,521 | B2 * | 8/2010 | Topolkaraev ..... | D04H 3/11 28/104 |
| 2002/0115370 | A1 | 8/2002 | Palacio et al. | |
| 2004/0068849 | A1 * | 4/2004 | Barge ..... | D04H 1/74 28/104 |
| 2004/0132374 | A1 | 7/2004 | Kobayashi | |
| 2009/0258559 | A1 * | 10/2009 | Anantharamaiah .... | D04H 1/498 442/334 |

OTHER PUBLICATIONS

Chinese Office Action and Search Report Corresponding to Application No. 201680084302 dated Jan. 27, 2020.

* cited by examiner

CLEANING PRODUCT WITH LOW LINT AND HIGH FLUID ABSORBENCY AND RELEASE PROPERTIES

RELATED APPLICATIONS

The present application is based upon and claims priority to PCT International Patent Application No. PCT/US2016/025845, filed on Apr. 4, 2016, which is incorporated herein by reference.

BACKGROUND

In many manufacturing processes, various parts and products need to be cleaned prior to applying a finish coating or prior to use. For instance, the surface of many parts and products need to be cleaned during manufacturing in order to remove grease, dirt, or any other formats of contaminants.

For instance, in the automotive industry, many articles of manufacture such as body panels and the like are painted or otherwise coated prior to assembly of the vehicle. Prior to applying a finishing coating, the surface of the article typically requires the removal of contaminants. A solvent impregnated wiper, for example, may be used to clean the surface of the article prior to application of the coating, such as paint.

Similarly, in the aerospace industry, the surface preparation of articles of manufacture in order to remove contaminants is especially important. The articles are cleaned in order to ensure the safety and quality of the products.

In the aerospace industry, in the automotive industry, and in similar industries, a solvent impregnated wiping material is used in order to remove contaminants, such as grease and dirt. During the process of cleaning the surface, a wiper is typically contacted with a solvent and the solvent is applied to the surface of the product using the wiper. Of particular importance is that the wiper leave no lint or any other contaminants onto the surface after an aggressive wiping motion.

In the relatively recent past, many industries are advancing towards the direction to have more and more composite materials replace metallic parts. These composite materials, for instance, may be used in aircrafts, motors, electrical components, automotive panels, and the like. The composite materials provide weight advantages with added benefits of durability. The surface preparation of a composite material, however, can be more challenging than cleaning the surface of a metal part. The composite surface, for instance, can be porous and thus be more abrasive than traditional metal surfaces. Commonly used wiping materials break down and form lint when wiping composite materials. Unfortunately, however, when efforts are made to improve the abrasion resistance of a wiping product, the ability of the wiping product to absorb solvents and to dispense the solvents onto a surface become compromised. For instance, the solvent may become trapped within the wiping structure and end up not being utilized. Underutilizing solvents not only adds significant cost to the product, but can create environmental concerns.

In view of the above, a need exists for a wiping product that not only has good abrasion and puncture resistance, but is also efficient in absorbing fluids and releasing the fluids onto an adjacent surface.

SUMMARY

In general, the present disclosure is directed to a wiper product that has a synergistic balance of physical properties.

The wiper product, for instance, can be constructed so as to be abrasion resistant and produce little to no lint during use, even when used against a porous or non-smooth surface, such as a surface or a part made from a composite material. In addition, the wiper product can be constructed so as to have excellent solvent delivery characteristics. In particular, the wiper product is not only efficient at absorbing solvents but is also efficient in releasing the solvents during use. In this manner, the amount of solvent needed during a cleaning process can be minimized.

In one embodiment, the present disclosure is directed to a wiper product that comprises a nonwoven web. The nonwoven web is formed from a combination of staple fibers and conjugate fibers. The staple fibers may be present in the nonwoven web in an amount from about 60% to about 90% by weight, such as from about 60% to about 80% by weight. The staple fibers may be comprised of cellulose or a thermoplastic polymer. The conjugate fibers, on the other hand, may be present in the nonwoven web in an amount from about 10% to about 40% by weight, such as in an amount from about 25% to about 40% by weight. The conjugate fibers comprise a core made from a first polymer and a sheath made from a second polymer. The staple fibers and the conjugate fibers can have a length of from about 10 mm to about 55 mm, such as from about 12 mm to about 20 mm. The fibers can have a size of from greater than 0.5 denier to less than 6 denier, such as from about 1 denier to about 2 denier.

In accordance with the present disclosure, the nonwoven web comprises a hydroentangled web in which the fibers are thermally bonded together. In one embodiment, thermal bonding can occur without compressing the web. For example, in one embodiment, the nonwoven web may comprise a through-air dried web. The nonwoven web can also have a water delivery (i.e. water release) of greater than about 4 g/g, such as greater than about 5.5 g/g.

Besides having excellent water capacity and water delivery characteristics, the wiper product can also have good abrasion resistance. For instance, when tested according to the Sandpaper Lint Test, the wiper product may produce less than about 0.55 g/m$^2$ of lint. When tested according to the Sieve Lint Test, on the other hand, the wiper product may produce less than about 15 mg/ft$^2$ of lint.

In one embodiment, the staple fibers are made from rayon fibers or are made from polyester fibers. The conjugate fibers, on the other hand, can be made from a sheath polymer comprising a copolyester or a polyethylene and a core polymer comprising a polyester. The nonwoven web can have a surface energy of from about 30 mJ/m$^2$ to about 35 mJ/m$^2$, can have a contact angle of at least 87°, such as from about 87° to about 93°, can have an average pore volume of from about 5.3 ml/g to about 6.3 ml/g, can have a pore area of from about 0.3 m$^2$/g to about 0.4 m$^2$/g, and can have a porosity of from about 80% to about 90%.

In one embodiment, the wiper product can be pre-impregnated with a solvent prior to use. The solvent may comprise water, a ketone, an ester-based organic solvent, a hydrocarbon-based solvent, an alcohol, or mixtures thereof.

The present disclosure is also directed to a method for producing a wiping product. The method includes hydroentangling a first side of a web formed from a combination of staple fibers and conjugate fibers as described above. The nonwoven web is then further hydraulically entangled by applying hydraulic energy to a second and opposite side of the web. The nonwoven web is then through-air dried in a manner that causes thermal bonding to occur between the fibers. The nonwoven web may comprise a wetlaid web, an airlaid web, or a carded web prior to being subjected to hydraulic entangling. In one embodiment, the first side of the nonwoven web is subjected to two different hydraulically entangling steps.

Other features and aspects of the present disclosure are discussed in greater detail below.

BRIEF DESCRIPTION OF DRAWINGS

A full and enabling disclosure of the present disclosure is set forth more particularly in the remainder of the specification, including reference to the accompanying figures, in which.

Figure 1:
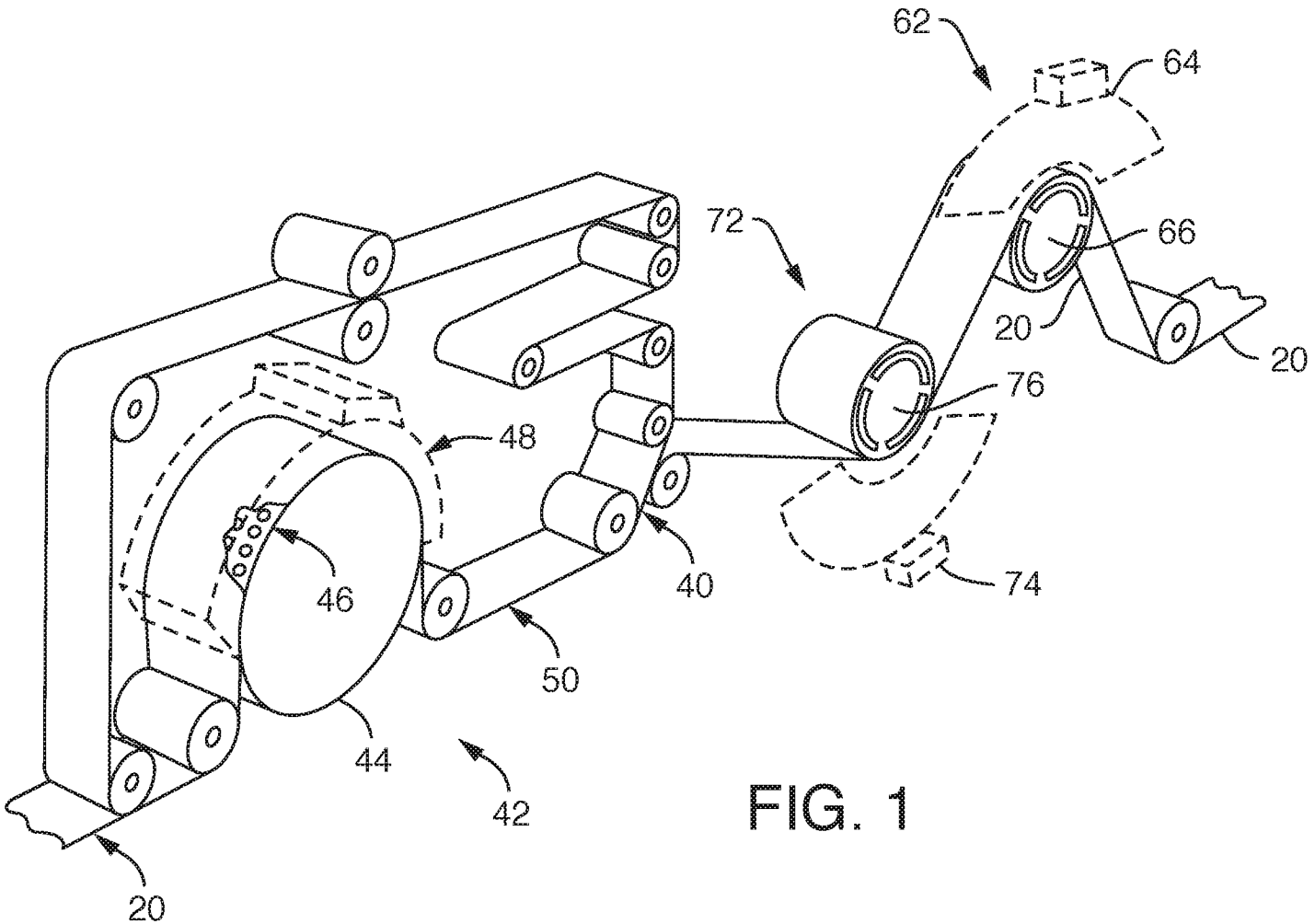
FIG. 1 is a perspective view of one embodiment of a process for producing wiping products made in accordance with the present disclosure.

Repeat use of reference characters in the present specification and drawings is intended to represent the same or analogous features or elements of the present invention.

Definitions

As used herein the term "nonwoven fabric or web" means a web having a structure of individual fibers or threads which are interlaid, but not in an identifiable manner as in a knitted fabric. Nonwoven fabrics or webs have been formed from many processes such as for example, dry-laid processes, wetlaid processes, and melt-spun processes. The basis weight of nonwoven fabrics is usually expressed in ounces of material per square yard (osy) or grams per square meter ($g/m^2$ or gsm) and the fiber diameters useful are usually expressed in microns. (Note that to convert from osy to gsm, multiply osy by 33.91).

The term "denier" is defined as grams per 9000 meters of a fiber. For a fiber having circular cross-section, denier may be calculated as fiber diameter in microns squared, multiplied by the density in grams/cc, multiplied by 0.00707. A lower denier indicates a finer fiber and a higher denier indicates a thicker or heavier fiber. Outside the United States the unit of measurement is more commonly the "tex," which is defined as the grams per kilometer of fiber. Tex may be calculated as denier/9. The "mean fiber denier" is the sum of the deniers for each fiber, divided by the number of fibers.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to wiping products having a synergistic blend of properties and to a method for producing the wiping products. For example, wiping products made in accordance with the present disclosure may have excellent abrasion resistance properties producing little to no lint during use, even when wiped against a non-smooth or porous surface. In addition, the wiping products have excellent fluid delivery characteristics. In particular, the wiping products are not only efficient at absorbing liquids but are also efficient at releasing liquids. In this manner, the amount of solvent, such as a cleaning solvent, used during wiping is minimized.

The wiping products of the present disclosure are well suited for absorbing a solvent, such as a cleaning solvent, and being used to wipe any suitable surface. The wiping products, for instance, are well suited to cleaning metal surfaces, such as the surfaces of metal parts prior to being painted. Of particular advantage, the wiping products of the present disclosure are also well suited for cleaning composite materials that may have a rougher surface than metal products.

In certain industries, especially the automotive and aerospace industries, cleaning products should be able to absorb great amounts of a solvent and release as much of the solvent as possible to the surface to be cleaned in a controlled manner. Additionally, for many applications, no new contaminants can be deposited on a surface once the surface has been cleaned. Thus, industries are placing more stringent requirements on the ability of wiping products to produce minimal lint during use. The wiping products of the present disclosure can be designed to produce little to no lint even when tested according to rigorous abrasion tests. Through the process of the present disclosure, wiping products can be produced that have a particular pore size distribution in combination with surface tension properties that not only create a product that can efficiently absorb and release liquids but that also is virtually lint-free during use.

In one embodiment, wiping products made according to the present disclosure are made from a nonwoven web containing a combination of staple fibers and conjugate fibers. The nonwoven web can initially be formed in a wetlaid process, an airlaid process, or a carded process. Once formed into a nonwoven web, the nonwoven web can be subjected to multiple hydroentangling processes. In one embodiment, for instance, the nonwoven web can be subjected to a first hydroentangling process by applying hydraulic energy to a first side of the web. The nonwoven web can then be subjected to a second hydroentangling process by applying hydraulic energy to a second and opposite side of the web. If desired, further hydraulically entangling processes can be carried out on the first side, on the second side or on both sides. After the hydroentangling processes, the fibers of the nonwoven web can be further thermally bonded together such that the web includes a combination of mechanical entanglement and thermal bonding. Thermal bonding can be achieved by employing various drying techniques known in the art, such as through-air drying, infrared drying, or impingement drying. In one embodiment, the nonwoven web can be fed through a through-air dryer at a temperature that causes thermal bonding to occur. Through-air drying the web bonds the fibers without significant compressive forces and thus maintains the bulk and absorbency characteristics of the web.

Referring to FIG. 1, one embodiment of a process for producing a wiping product in accordance with the present disclosure is shown. As illustrated, a nonwoven web 20 is fed through multiple hydroentangling processes and then thermally bonded together by flowing heated air through the web without otherwise compressing the web.

The nonwoven web 20 being fed through the process can be formed through a wetlaid process, an airlaid process, or a carding process. The nonwoven web 20 contains a mixture of fibers. For example, in one embodiment, the nonwoven web 20 contains staple fibers combined with conjugate fibers. The staple fibers, for instance, may comprise monocomponent fibers. As used herein, a monocomponent fiber is a fiber made from a single polymer material or from a substantially homogeneous blend of a plurality of polymer materials. The staple fibers may comprise synthetic staple fibers made from thermoplastic polymers or may comprise cellulosic fibers, such as fibers made from regenerated cellulose.

The synthetic staple fibers are made from one or more thermoplastic polymers. Examples of synthetic fibers that may be used in accordance with the present disclosure include polyamide fibers such as nylon fibers, polyester fibers such as fibers made from polyethylene terephthalate, polyolefin fibers such as polyethylene fibers or polypropylene fibers, and mixtures thereof. The synthetic fibers can have a fiber length in the range of from about 10 mm to about 55 mm. For example, the synthetic fibers can have a fiber length of from about 12 mm to about 20 mm. When producing wetlaid webs, for instance, the fibers can have a length of from about 10 mm to about 20 mm. When producing carded webs, on the other hand, the fibers can generally have a length of from about 35 mm to about 55 mm. The fibers can have a diameter of from about 8 microns to about 25 microns, such as from about 10 microns to about 25 microns, such as from about 10 microns to about 15 microns. The fibers can have a size of greater than about 0.5 denier, such as about 0.7 denier or more, such as about 1 denier or more, such as about 1.3 denier or more and about 6 denier or less, such as about 3 denier or less, such as about 2 denier or less. The fibers can have a size of from about 0.7 denier to about 6 denier, such as from about 1 denier to about 3 denier, such as from about 1.3 denier to about 2 denier.

In an alternative embodiment, the staple fibers may comprise regenerated cellulose fibers. Cellulosic regenerated fibers are man-made filaments obtained by extruding or otherwise treating regenerated or modified cellulosic materials from woody or non-woody plants. For example, cellulosic regenerated fibers may include rayon fibers, such as lyocell fibers, viscose fibers, or mixtures thereof, and the like. The regenerated fibers can have a fiber length in the range of from about 10 mm to about 55 mm. For example, the regenerated fibers can have a fiber length of from about 12 mm to about 20 mm. Additionally, the regenerated fibers may have a fineness such that the fibers have a diameter of greater than about 8 microns, such as greater than about 9 microns, such as greater than about 10 microns, such as greater than about 12 microns, such as greater than about 15 microns. The fiber diameters are generally less than about 25 microns, such as less than about 23 microns, such as less than about 20 microns, such as less than about 18 microns, such as less than about 15 microns. The cellulose fibers or regenerated cellulose fibers can have a size of greater than about 0.5 denier, such as greater than about 1 denier, such as greater than about 1.25 denier, such as greater than about 1.5 denier. The fiber size is generally less than about 6 denier, such as less than about 4 denier, such as less than about 3 denier, such as less than about 2.5 denier, such as less than about 2 denier.

In one particular embodiment, the staple fibers comprise polyester fibers and the nonwoven web can be free of any polyamide fibers. Polyester fibers are generally stronger than polypropylene and polyethylene fibers. Further, when used to produce webs in accordance with the present disclosure, the polyester fibers have been found to not only efficiently release solvents from the web but are chemically resistant. Polyester fibers are also compatible with the solvents and with the conjugate fibers.

The staple fibers are generally present in the nonwoven web in an amount greater than about 60% by weight, such as in an amount greater than about 65% by weight, such as in an amount greater than about 70% by weight, such as in an amount greater than about 75% by weight, such as in an amount greater than about 80% by weight, such as in an amount greater than about 85% by weight. The staple fibers are generally present in an amount less than about 90% by weight, such as in an amount less than about 85% by weight, such as in an amount less than about 80% by weight, such as in an amount less than about 75% by weight.

In addition to staple fibers, the nonwoven web also contains conjugate fibers. As used herein, the term "conjugate fibers" refers to fibers or filaments which have been formed from at least two separate polymers but formed together to form one fiber. Conjugate fibers are also sometimes referred to as "multicomponent" or "bicomponent" fibers or filaments. The term "bicomponent" means that there are two polymeric components making-up the fibers. The polymers are usually different from each other though conjugate fibers may be prepared from the same polymer, but the polymers are different from one another in some physical property, such as, for example, melting point or the softening point. The polymers are arranged in substantially constantly positioned distinct zones across the cross-section of the multicomponent fibers or filaments and extend continuously along the length of the multicomponent fibers or filaments. The configuration of such a multicomponent fiber may be, for example, a sheath/core arrangement, wherein one polymer is surrounded by another, a side-by-side arrangement, a pie arrangement or an "islands-in-the-sea" arrangement. Multicomponent fibers are taught in U.S. Pat. No. 5,108,820 to Kaneko et al., U.S. Pat. No. 5,336,552 to Strack et al., and U.S. Pat. No. 5,382,400 to Pike et al., the entire content of each is incorporated herein by reference. For two component fibers or filaments, the polymers may be present in ratios of 75/25, 50/50, 25/75 or any other desired ratios.

In one embodiment, the conjugate fibers include a core surrounded by a sheath. The core can be made from a first polymer, while the sheath can be made from a second polymer. In general, the sheath is made from a polymer that has a lower melting point than the polymer used to make the core. For example, the polymer used to make the sheath can have a melting point of about 150° C. or less, such as about 135° C. or less, such as about 125° C. or less, such as about 120° C. or less and about 100° C. or more, such as 105° C. or more, such as about 110° C. or more, such as about 115° C. or more.

In general, any of the polymers described above with respect to the synthetic staple fibers may be used to also construct the conjugate fibers. For example, the polymers suitable include polyolefins, polyesters, polycarbonates, polyvinylchloride, polystyrene, polyethylene terephathalate, biodegradable polymers such as polylactic acid and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene, and blends thereof; polybutylene, e.g., poly(1-butene) and poly(2-butene); polypentene, e.g., poly(1-pentene) and poly(2-pentene); poly(3-methyl-1-pentene); poly(4-methyl 1-pentene); and copolymers and blends thereof. Suitable copolymers include random and block copolymers prepared from two or more different unsaturated olefin monomers, such as ethylene/propylene and ethylene/butylene copolymers. Suitable polyesters and copolyesters include polyethylene terephthalate, polytrimethylene terephthalate, polybutylene terephthalate, polytetramethylene terephthalate, polycyclohexylene-1,4-di-methylene terephthalate, and isophthalate copolymers thereof, as well as blends thereof.

In one embodiment, the conjugate fibers may comprise bicomponent fibers. The polymer used to produce the core may comprise polyethylene terephthalate or polypropylene. The polymer used to form the sheath, on the other hand, may comprise a copolyester or polyethylene.

The conjugate fibers can have a fiber length within the same range as the fiber length of the staple fibers as described above. For instance, the fiber length of the conjugate fibers can be greater than about 10 mm, such as greater than about 15 mm, such as greater than about 18 mm, such as greater than about 20 mm, such as greater than about 25 mm. The fiber length is generally less than about 55 mm, such as less than about 50 mm, such as less than about 45 mm, such as less than about 40 mm, such as less than about 30 mm. The fiber length is generally from about 10 mm to about 20 mm when forming wetlaid webs and can be from about 35 mm to about 55 mm when producing carded webs.

The conjugate fibers can have fiber sizes also within the same range as the staple fibers described above. For instance, the conjugate fibers can have a size of greater than about 0.5 denier, such as greater than about 0.8 denier, such as greater than about 1 denier, such as greater than about 1.25 denier, such as greater than about 1.5 denier, such as greater than about 2 denier. The fiber size of the conjugate fibers is generally less than about 3 denier, such as less than about 2.5 denier, such as less than about 2 denier, such as less than about 1.5 denier.

The conjugate fibers are present in the nonwoven web in an amount greater than about 10% by weight, such as greater than about 15% by weight, such as greater than about 20% by weight, such as greater than about 25% by weight, such as greater than about 30% by weight. The conjugate fibers are present in the nonwoven web in an amount less than about 40% by weight, such as in an amount less than about 35% by weight.

In one embodiment, the nonwoven web only contains the staple fibers and the conjugate fibers and does not contain any other fibers. In fact, in one embodiment, the nonwoven web is only made from the staple fibers and the bicomponent fibers and may contain no other fillers, particles, fibers, and the like.

Referring back to FIG. 1, once the nonwoven web is formed, the web is subjected to multiple hydroentangling processes. The hydraulic entangling may be accomplished utilizing conventional hydraulic entangling equipment such as may be found in, for example, in U.S. Pat. No. 3,485,706 to Evans, the disclosure of which is hereby incorporated by reference. The hydraulic entangling of the present disclosure may be carried out with any appropriate working fluid such as, for example, water. The working fluid flows through a manifold which evenly distributes the fluid to a series of individual holes or orifices. These holes or orifices may be from about 60 microns to about 200 microns in diameter, such as from about 100 microns to about 140 microns in diameter. For example, the invention may be practiced utilizing a manifold containing a strip having 120 micron diameter orifices with a spacing of 600 microns and 1 row of holes. Many other manifold configurations (e.g., several manifolds arranged in succession) and combinations may be used.

In the hydraulic entangling process, the working fluid passes through the orifices at a pressures ranging from about 200 to about 4000 pounds per square inch gage (psig). At the upper ranges of the described pressures it is contemplated that the nonwoven material may be processed at speeds of about 1000 feet per minute (fpm). The fluid impacts the nonwoven web 20 which is supported by a foraminous surface which may be, for example, a single plane mesh having a mesh size of from about 40×40 to about 120×120. As is typical in many water jet treatment processes, vacuum slots may be located directly beneath the hydro-needling manifolds or beneath the foraminous entangling surface downstream of the entangling manifold so that excess water is withdrawn from the hydraulically entangled nonwoven material.

The columnar jets of working fluid which directly impact fibers of the fibrous material 20 work to entangle the fibers and form a more coherent structure. The conjugate fibers are entangled with the staple fibers of the nonwoven web 20 and with each other.

In accordance with the present disclosure, the nonwoven web 20 is subjected to multiple hydroentangling steps. In one embodiment, for instance, a first side of the nonwoven web is subjected to sufficient amounts of hydraulic energy to cause hydroentangling within the web. The second side or opposite side of the nonwoven web can then be subjected to a hydroentangling process in which hydraulic energy is applied to the second side for hydroentangling to occur. In one embodiment, the nonwoven web can be subjected to further hydroentangling processes. For instance, each side of the nonwoven web can be subjected to two or more hydroentangling processes. In one particular embodiment, for instance, the first side of the web is subjected to one to three hydroentangling processes and the second side of the web is subjected to one to three hydroentangling processes. The number of hydroentangling processes carried out on each side of the web can be the same or different. In one particular embodiment, for instance, the first side of the web may be subjected to two hydroentangling processes while the opposite and second side of the web may be subjected to a single hydroentangling process. The second side of the web, for instance, can be subjected to a hydroentangling process inbetween subjecting the first side of the web to two different hydroentangling steps.

In the embodiment illustrated in FIG. 1, for instance, the nonwoven material 20 is subjected to two hydroentangling processes in which the hydraulic energy is applied to opposite sides of the web. Referring to FIG. 1, for instance, the nonwoven material 20 is fed into a hydraulic entangling machine 62. In the embodiment illustrated, the hydraulic entangling machine 62 includes hydraulic entangling manifolds 64 that eject jets of fluid to entangle the fibers contained in the nonwoven web 20. The hydraulic entangling manifold 64 is positioned over a hydraulic entangling drum 66. As shown in FIG. 1, the nonwoven web 20 is rotated over the drum 66 while subjected to hydraulic energy from the hydraulic entangling manifold 64. Thus, the first side of the nonwoven web 20 is subjected to a hydroentangling process while the web is traveling in a curvilinear path.

From the hydroentangling machine 62, the web is then fed through a further hydroentangling machine 72. Hydroentangling machine 72 includes hydroentangling manifolds 74 positioned opposite a hydroentangling drum 76. The nonwoven web 20 rotates over the drum 76 while being subjected to hydraulic energy. The fluids being forced through the web are collected within the drum and carried away.

Hydroentangling drum 66 and 76 can be covered with various surfaces known in the art, such as mesh screens having a size of from about 40×40 to about 120×120, multi porous screens, and 3 dimensional patterning screens. When the web is rotated with the hydroentangling drum 66, the first side of the web is subjected to hydraulic energy from the hydraulic entangling manifold 64. When the web is rotated with the hydroentangling drum 76, on the other hand, the second side and opposite side of the web is subjected to hydraulic energy from the hydraulic entangling manifold 74. In this manner, the two hydroentangling machines 62 and 72 work in conjunction to apply hydraulic energy to opposite sides of the nonwoven material 20.

During hydraulic entangling of the web 20 as the web is passing through the hydraulic entangling machine 72, the fibers within the web are being further rearranged and reoriented while the web is traveling along a curvilinear path.

In the embodiment illustrated in FIG. 1, the web is subjected to a hydroentangling process while traveling in a curvilinear path. It should be understood, however, that the web can also be traveling in a linear path during the hydroentangling step. For example, in one embodiment, the nonwoven web can be first subjected to a hydroentangling step while traveling in a horizontal and linear path and then may be subjected to a second hydroentangling step directed to the opposite side of the web while the web is traveling in a curvilinear path.

The further hydraulic entangling steps improve the overall properties of the wiper product. Subjecting each side of the nonwoven material to one or more hydraulic entangling steps, for instance, can significantly improve the strength properties of the material. Of particular advantage, the strength properties are improved without adversely affecting other properties. For instance, in addition to good strength characteristics, nonwoven materials made according to the present disclosure can have excellent liquid absorbent properties and can have excellent abrasion resistance.

After the plurality of fluid jet treatments, the nonwoven web 20 may be dewatered, such as via vacuum dewatering, to prepare the web for drying. The drying may be performed using various methods known in the art such as through-air drying, infrared drying, impingement drying, conduction drying, and the like. In one embodiment, the drying is a non-compressive form of drying in order to maintain the thickness of the web and the absorbent capacity.

Thereafter, the nonwoven web 20 may be transferred to a non-compressive bonding operation. Alternatively, bonding may be performed on the same unit or apparatus employed for the aforementioned drying step. Non-compressive bonding of the web may be accomplished utilizing a conventional rotary drum through-air drying apparatus shown in FIG. 1 at 42. The through-dryer 42 may be an outer rotatable cylinder 44 with perforations 46 in combination with an outer hood 48 for receiving hot air blown through the perforations 46. In an alternative embodiment, hot air may be emitted by the outer hood 48 and collected in the cylinder 44. In the embodiment illustrated, a through-dryer belt 50 carries the nonwoven web 20 over the upper portion of the outer rotatable cylinder 44. In an alternative embodiment, no carrier fabric may be needed in order to convey the nonwoven material through the through-air dryer. The heated air forced through the material 20 removes water and causes the conjugate fibers to bond at crossover points with other fibers. The temperature of the air forced through the nonwoven material 20 by the through-dryer 42 may range from about 110° to about 250° F. In one embodiment, the temperature of the air forced through the nonwoven material can be greater than about 120° C., such as greater than about 130° C. The temperature of the air forced through the nonwoven material 20 can generally be less than about 170° C., such as less than about 160° C., such as less than about 150° C. The speed at which the nonwoven web travels through the through-air dryer can vary depending upon numerous factors.

The non-compressive bonding step further bonds the fibers of the nonwoven web 20 together. Of particular advantage, the web can be bonded while retaining bulk and thickness characteristics. For instance, the wiping product can have a caliper of greater than about 20 mils, such as greater than about 24 mils, such as greater than about 26 mils. The caliper is generally less than about 50 mils.

It may be desirable to use finishing steps and/or post treatment processes generally employed in the art to impart selected properties to the nonwoven material 20.

The basis weight of wiper products made in accordance with the present disclosure can vary depending upon various factors including the intended use of the product. In general, the basis weight is greater than about 20 gsm, such as greater than about 25 gsm, such as greater than about 30 gsm, such as greater than about 40 gsm. The basis weight of the wiper product is generally less than about 300 gsm, such as less than about 250 gsm, such as less than about 200 gsm, such as less than about 175 gsm, such as less than about 150 gsm, such as less than about 125 gsm, such as less than about 110 gsm, such as less than about 100 gsm, such as less than about 90 gsm.

Figure 2:
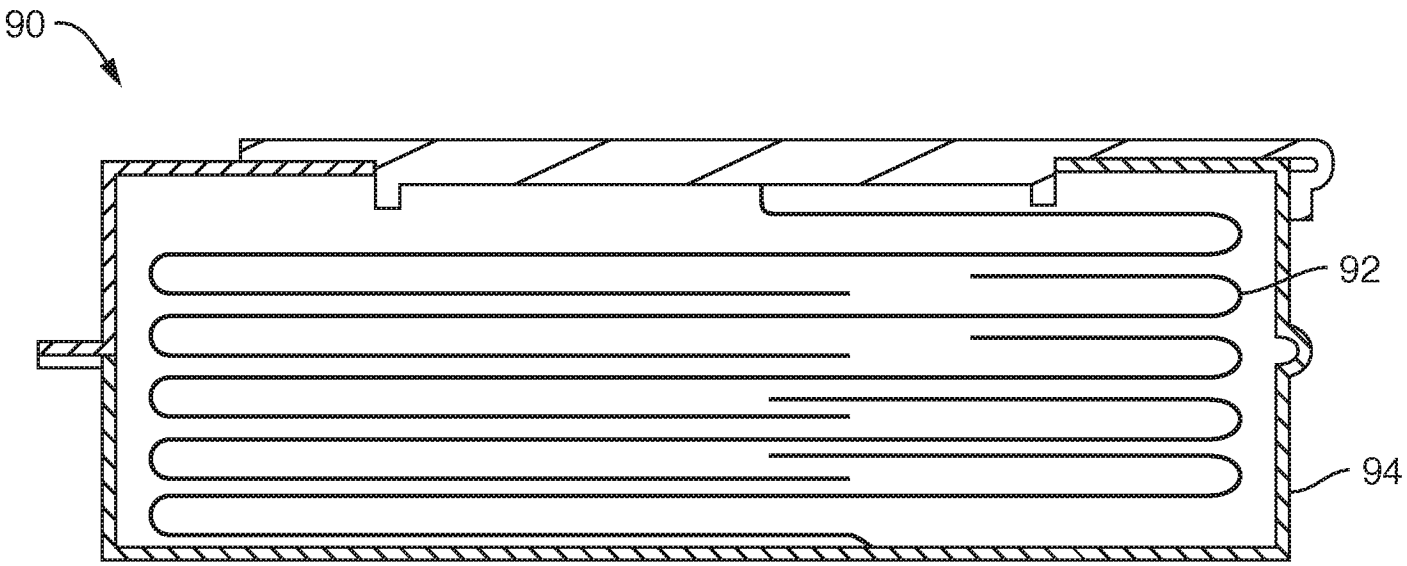
FIG. 2 is a perspective view of one embodiment of a wiping product made in accordance with the present disclosure.

Once the nonwoven material is produced, the material can be further processed and packaged as a wiper product. For example, in one embodiment, the nonwoven web can be cut into individual sheets. The sheets can be interfolded and packaged into a dispenser. For example, referring to FIG. 2, one embodiment of a wiper product 90 made in accordance with the present disclosure is shown. The wiper product 90 includes individual wipers 92 that are interfolded and arranged in a stack. The stack of wipers is contained in a dispenser 94 for dispensing the wipers one at a time.

In one embodiment, the nonwoven web can be pre-moistened or pre-impregnated with a solvent, such as a cleaning solvent, prior to being packaged. The solvent may comprise any suitable solvent based upon the end use application of the wiper. In one embodiment, for instance, the solvent may comprise water. In an alternative embodiment, the solvent may comprise a volatile organic compound. Examples of solvents include a ketone, an alcohol, or other organic solvents, such as an ester-based solvent and hydrocarbon-based solvents (e.g., benzene, xylene, toluene, etc.). In one embodiment, the solvent may comprise isopropyl alcohol and naptha. In an alternative embodiment, the solvent may contain dipropylene glycol monomethylether.

Wiping products made in accordance with the present disclosure and made according to the process described above can be constructed so as to have a synergistic blend of properties. In particular, the wiping products can have excellent absorbency and release properties in combination with excellent abrasion resistance properties. The nonwoven web, for instance, can have surface energy characteristics of from about 25 $mJ/m^2$ to about 50 $mJ/m^2$, such as from about 30 $mJ/m^2$ to about 35 $mJ/m^2$. The nonwoven web can have a contact angle of greater than about 87°, such as greater than about 90°, such as greater than about 92°. The contact angle can generally be less than about 97°, such as less than about 93°. The nonwoven web can have an average pore diameter of from about 60 to about 85 microns. The pore volume can be from about 5.3 ml/g to about 6.3 ml/g. The pore area can be greater than about 0.3 $m^2/g$, such as greater than about 0.35 $m^2/g$ and can generally less than about 0.5 $m^2/g$, such as less than about 0.45 $m^2/g$, such as less than about 0.4 $m^2/g$. The nonwoven web can have a porosity of from about 75% to about 95%, such as from about 80% to about 90%.

The nonwoven web can have an absorbent capacity when tested with water of greater than about 5 g/g, such as greater than about 5.5 g/g, such as even greater than about 6 g/g. The water capacity is generally less than about 8 g/g, such as less than about 7 g/g.

The solvent delivery of the nonwoven web is calculated by multiplying the absorbent capacity with the percent release of the fluid contained in the web. The nonwoven web can have a water release of greater than about 90%, such as greater than about 92%, such as greater than about 94%, such as even greater than about 95%. The water release is less than about 100%. When tested with water, the nonwoven web may have a solvent or water delivery of greater than about 4 g/g, such as greater than about 4.2 g/g, such as greater than about 4.4 g/g, such as greater than about 4.6 g/g, such as greater than about 4.8 g/g, such as greater than about 5 g/g, such as greater than about 5.2 g/g, such as greater than about 5.4 g/g. The water delivery is generally less than about 7 g/g.

In order to test for abrasion resistance, in one embodiment, the nonwoven web can be tested according to a Sandpaper Lint Test (AMS3819C) in which the material is tested against sandpaper and a Sieve Lint Test (AMS3819C) in which the material is tested against a sieve. When tested according to the Sandpaper Lint Test, the nonwoven web produces less than about 0.55 $g/m^2$ of lint, such as less than about 0.3 $g/m^2$ of lint, such as less than about 0.1 $g/m^2$ of lint, such as less than about 0.05 $g/m^2$ of lint. When tested according to the Sieve Lint Test, the nonwoven web can produce less than about 15 $mg/ft^2$ of lint, such as less than about 10 $mg/ft^2$ of lint, such as less than about 8 $mg/ft^2$ of lint, such as less than about 5 $mg/ft^2$ of lint, such as less than about 3 $mg/ft^2$ of lint.

EXAMPLE

Different wiper products were made in accordance with the present disclosure and tested for various properties. The wiper products were made from a fiber furnish containing staple fibers combined with bicomponent fibers. The staple fibers comprised polyethylene terephthalate (PET) fibers. The bicomponent fibers included a core polymer made from polyester and a sheath polymer made from a copolyester. The wiper products were made generally according to the above described process. In particular, the nonwoven web was made from a wetlaid process and then each side of the web was hydroentangled. The web was then fed through a through-air dryer. The amount of staple fibers in relation to the amount of bicomponent fibers was varied. In addition, the thermal bonding temperature and the thermal bonding speed varied.

The following tests were conducted on the dry product.

Absorbent Capacity Test: As used herein, "absorbent capacity" refers to the amount of liquid that an initially 4-inch by 4-inch (102 mm×102 mm) sample of material can absorb while in contact with a pool 2 inches (51 mm) deep of room-temperature (23+/−2 degrees C.) liquid for 3 minutes+/−5 seconds in a standard laboratory atmosphere of 23+/−1 degrees C. and 50+/−2% RH and still retain after being removed from contact with liquid and being clamped by a one-point clamp to drain for 3 minutes+/−5 seconds. Absorbent capacity is expressed as both an absolute capacity in grams of liquid and as a specific capacity of grams of liquid held per gram of dry fiber, as measured to the nearest 0.01 gram. At least three specimens are tested for each sample. Samples may be tested for their absorbent capacity in water, in mineral oil and in 50 weight motor oil.

Water Release Test:

The following procedure is used to test the water retention of four different samples. The procedure may be easily adapted to test any number of samples. The test is performed using a centrifuge capable of 1500 rpm, such as the Sorvalrt 6000D and using a balance readable to 0.001 g. The samples used are 2 inch diameter circles cut using a cutting press and die.

Steps:

1. Label four 250 ml beakers 1 through 4.
2. Fill each beaker with approximately 125 ml of deionized (DI) water.
3. Weigh each sample dry at room temperature. Record the weight.
4. After weighing, place each sample onto the surface of DI water in each beaker.
5. Start the timer and allow samples to soak for approximately 15 minutes.

Note: If sample does not sink after 5 minutes push it down into the water.

6. During the 15 minute wait time, label and weigh each set of the sample holders (sample holder, beaker, screen) and record the weight.
7. Remove the samples from the liquid.

7.1. Remove the first sample from the beaker using tweezers.

7.2. Hold the sample on edge allowing water to drip from the sample for approximately 10 seconds.

7.3. Place the sample on top of the screen inside the plastic beaker of the centrifuge sample holder.

7.4. Place on balance and record the weight.

7.5. Repeat from 7.1 for remaining specimens.

Figure 3:
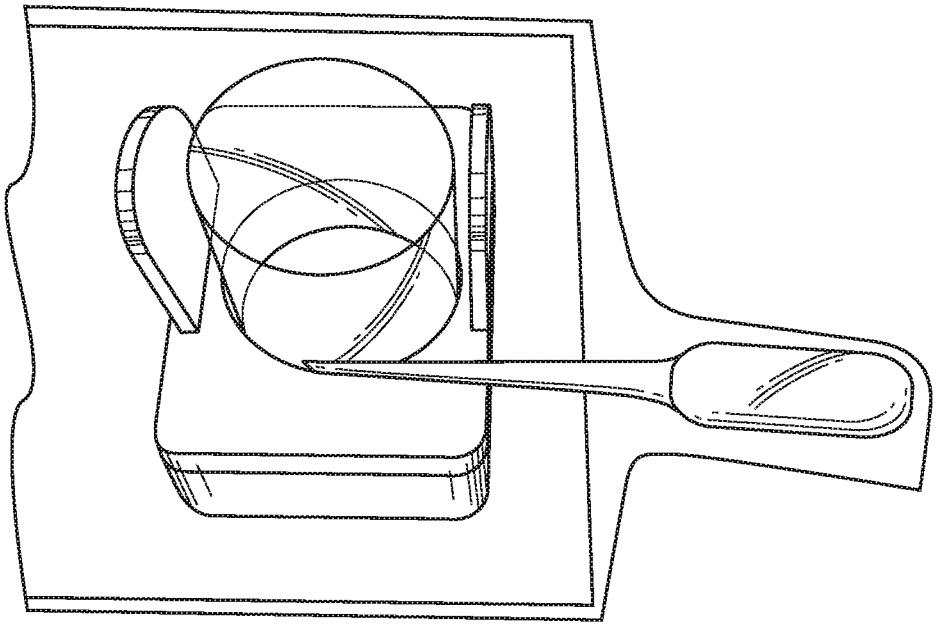
FIG. 3 is a perspective view of the sample holder used for the Water Release Test procedure described below.

8. Sample holder balance (see FIG. 3):

8.1. Place the sample holder with the highest weight reading in 7.4 on the balance and tare it.

8.2. Place another sample holder on the balance and add water to the outside of the plastic beaker until the balance reads 0.0+0.001 g.

8.3. Repeat step 8.2 until all sample holders are of equal weight.

9. Place all sample holders into the centrifuge.
10. Close centrifuge lid and lock.
11. Set the RPM to 1500.
12. Set the timer to 3 minutes.
13. Centrifuge will start.
14. After 3 minutes, the centrifuge will slowly reduce the speed and stop.
15. Take out the sample holders.
16. Place a plastic weigh tray on the balance and tare.
17. Remove the first sample using tweezers and place in the weigh tray.
18. Record weight immediately to avoid evaporation loss.
19. Repeat 7 for remaining 3 samples.
20. Drain all sample holders and dry.
21. Calculations:

21.1. Weight of total water on sample=(Wet weight of sample in sample holder before centrifuge)−(Dry weight of empty sample holder+Dry weight sample weight)

21.2. Retention=Wet weight of sample after centrifuge−Dry weight of sample

Delivery Test:

Delivery (g/g)=absorbent capacity (g/g)×release (%)

Sandpaper Lint Test and Sieve Lint Test:

The Sandpaper Lint Test and the Sieve Lint Test were tested according to Test AMS3819C.

Pore Size Analysis:

Pore size analysis was completed using a Porosimetry by Mercury Intrusion, Test 267, May 1, 2012, Stage 6 harmonization, ©2011 The United States Pharmacopeial Convention.

The following results were obtained:

| | Bicomponent | Staple | Thermal | Thermal | Abrasion Lint | | Water Delivery | | |
|---|---|---|---|---|---|---|---|---|---|
| Sample No. | Fiber Percentage (%) | Fiber Percentage (%) | Bonding Temperature (° C.) | Bonding Speed (fpm) | Sandpaper Lint ($g/m^2$) | Sieve Lint ($mg/ft^2$) | Water Capacity (g/g) | Water release (%) | Delivery (g/g) |
| 1 | 30 | 70 | 140 | 30 | 0.03 | 2.7 | — | — | — |
| 2 | 30 | 70 | 140 | 15 | 0.02 | 3 | 6 | 95 | 5.7 |
| 3 | 30 | 70 | 130 | 30 | 0.14 | 5.45 | — | — | — |
| 4 | 30 | 70 | 130 | 15 | 0.12 | 3.85 | — | — | — |
| 5 | 30 | 70 | 120 | 30 | 0.2 | 3.39 | — | — | — |
| 6 | 20 | 80 | 140 | 30 | 0.37 | 3.15 | — | — | — |
| 7 | 20 | 80 | 140 | 15 | 0.06 | 3.42 | 6.5 | 96 | 6.2 |
| 8 | 20 | 80 | 130 | 30 | 0.36 | 3.28 | — | — | — |
| 9 | 20 | 80 | 130 | 15 | 0.22 | 2.31 | — | — | — |
| 10 | 20 | 80 | 120 | 30 | 0.13 | 3.77 | — | — | — |
| 11 | 10 | 90 | 140 | 30 | 0.3 | 3.38 | — | — | — |
| 12 | 10 | 90 | 140 | 15 | 0.37 | 5.6 | 6.4 | 96 | 6.1 |
| 13 | 10 | 90 | 130 | 15 | 0.28 | 3.09 | — | — | — |
| 14 | 10 | 90 | 120 | 30 | 0.23 | 2.84 | — | — | — |
| 15 | 40 | 60 | 170 | 30 | 0.09 | 3.3 | 5.8 | 95 | 5.5 |
| 16 | 40 | 60 | 170 | 15 | 0 | 1.6 | 6.1 | 95 | 5.8 |

Example No. 2

Sample No. 2 from Example No. 1 above was tested against three different commercial wiping products. The following results were obtained:

| Sample No. | Fiber Composition | Sandpaper Lint ($g/m^2$) | Sieve Lint ($mg/ft^2$) | Water Capacity (g/g) | Water Release (%) | Delivery (g/g) |
|---|---|---|---|---|---|---|
| Sample No. 2 | 30% PET bicomponent (2.2 dtex, 12 mm) 70% PET (1.5 denier, 12 mm) | 0.02 | 3 | 6 | 96 | 5.8 |
| Commercial Sample No. 1 | 50 gsm, 100% PP Bonded carded web (hydrophilic treatment) | 0 | 4.05 | 4.2 | 95 | 4.0 |
| Commercial Sample No. 2 | Knitted polyester 100% PET | 0 | 1.87 | 2.6 | 86 | 2.2 |
| Commercial Sample No. 3 | 55% pulp/45% PET, hydroentangled web | 0.17 | 21.4 | 4.8 | 69 | 3.3 |

As shown above, the wiping product made according to the present disclosure had a much better overall balance of properties than the three commercial products.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A wiper product comprising:

a nonwoven web containing a mixture of staple fibers and conjugate fibers, the staple fibers being comprised of a thermoplastic polymer comprising polyester, the staple fibers being present in the nonwoven web in an amount from about 60% to about 90% by weight, the conjugate fibers comprising a core comprising polyethylene terephthalate or polypropylene and a sheath comprising copolyester or polyethylene, the conjugate fibers being present in the nonwoven web in an amount from about 10% to about 40% by weight; and wherein the staple fibers and the conjugate fibers both have a median fiber length of from about 10 mm to about 55 mm, the staple fibers and the conjugate fibers having a size of from about 1 denier to about 3 denier;

wherein the fibers contained in the nonwoven web are thermally bonded together and wherein the web has a water capacity of greater than about 5 g/g and has a water delivery of greater than about 4 g/g;

wherein the nonwoven web has an average pore volume of from about 5.3 ml/g to about 6.3 ml/g, has a pore area of from about 0.3 $m^2/g$ to about 0.4 $m^2/g$, and has a porosity of from about 80% to about 90%; and wherein the nonwoven web has a basis weight of from about 20 gsm to less than 90 gsm.

2. A wiper product as defined in claim 1, wherein the nonwoven web comprises a hydroentangled web.

3. A wiper product as defined in claim 1, wherein the nonwoven web contains the conjugate fibers in an amount from about 25% to about 40% by weight.

4. A wiper product as defined in claim 1, wherein the nonwoven web has a water delivery of greater than about 5 g/g.

5. A wiper product as defined in claim 1, wherein the nonwoven web has a water capacity of greater than about 5.5 g/g.

6. A wiper product as defined in claim 1, wherein the staple fibers and the conjugate fibers have a size of from about 1 denier to about 2 denier.

7. A wiper product as defined in claim 1, wherein the nonwoven web has a surface energy of from about 30 $mJ/m^2$ to about 35 $mJ/m^2$ and has a contact angle of at least 87°.

8. A wiper product as defined in claim 1, wherein the wiper product, when tested according to the Sandpaper Lint Test, produces less than 0.55 $g/m^2$ lint and when tested according to the Sieve Lint Test produces less than 162 $mg/m^2$ (15 $mg/ft^2$) lint.

9. A wiper product as defined in claim 1, wherein the sheath of the conjugate fibers comprises a copolyester or a polyethylene polymer.

10. A wiper product as defined in claim 1, wherein the nonwoven web comprises a wetlaid web, an airlaid web, or a carded web.

11. A wiper product as defined in claim 1, wherein the nonwoven web comprises a through-air dried web.

12. A wiper product as defined in claim 1, wherein the nonwoven web is made from fibers that consist of a blend of the staple fibers and the conjugate fibers.

13. A wiper product as defined in claim 1, wherein the solvent comprises water, a ketone, an ester-based organic solvent, a hydrocarbon-based solvent, an alcohol, or mixtures thereof.

14. A method for producing a wiper product comprising:

forming a nonwoven web through a wetlaid, airlaid, or carded process;

hydraulically entangling a first side of the nonwoven web, the nonwoven web containing staple fibers in an amount from about 60% to about 90% by weight, the staple fibers being comprised of a thermoplastic polymer comprising polyester, the staple fibers being blended with conjugate fibers, the conjugate fibers being present in the nonwoven web in an amount from about 10% to about 40% by weight, the conjugate fibers comprising a core made from polyethylene terephthalate or polypropylene and a sheath made from copolyester or polyethylene, the nonwoven web having a second side opposite the first side; wherein the staple fibers and the conjugate fibers both have a median fiber length of from about 10 mm to about 20 mm, the staple fibers and the conjugate fibers having a size of from about 1 denier to about 3 denier;

hydraulically entangling the second side of the nonwoven web by applying hydraulic energy to the second side of the web;

through-air drying the web that causes thermal bonding to occur between the staple fibers and the conjugate fibers;

wherein the nonwoven web has an average pore volume of from about 5.3 ml/g to about 6.3 ml/g, has a pore area of from about 0.3 $m^2/g$ to about 0.4 $m^2/g$, and has a porosity of from about 80% to about 90%; and wherein the nonwoven web has a basis weight of from about 20 gsm to less than 90 gsm.

15. The method as defined in claim 14, wherein the nonwoven web contains the conjugate fibers in an amount from about 25% to about 40% by weight.

16. The method as defined in claim 14, wherein the nonwoven web has a water delivery of greater than about 5 g/g.

17. The method as defined in claim 14, wherein the nonwoven web has a water capacity of greater than about 5.5 g/g.

18. The method as defined in claim 14, wherein the sheath of the conjugate fibers is made from a copolyester.

19. The method as defined in claim 14, wherein the staple fibers and the conjugate fibers have a median fiber length of from about 12 mm to about 20 mm and wherein the staple fibers and the conjugate fibers have a size of from about 1 denier to about 3 denier.

20. The method as defined in claim 14, wherein the nonwoven web has a surface energy of from about 30 $mJ/m^2$ to about 35 $mJ/m^2$, a contact angle of at least 87°, and when tested according to the Sandpaper Lint Test produces less than 0.55 $g/m^2$ lint and when tested according to the Sieve Lint Test produces less than 55 $mg/m^2$ (5 $mg/ft^2$) lint.

21. A wiper product comprising:

a wetlaid, airlaid, or carded nonwoven web containing a mixture of staple fibers and conjugate fibers, the staple fibers being comprised of a thermoplastic polymer comprising polyester, the staple fibers being present in the nonwoven web in an amount from about 60% to about 90% by weight, the conjugate fibers comprising a core comprising polyethylene terephthalate or polypropylene and a sheath comprising copolyester or polyethylene, the conjugate fibers being present in the nonwoven web in an amount from about 10% to about 40% by weight; wherein the staple fibers and the conjugate fibers both have a median fiber length of from about 10 mm to about 55 mm, the staple fibers and the conjugate fibers having a size of from about 1 denier to about 3 denier; and wherein the fibers contained in the nonwoven web are thermally bonded together and wherein the web has a water capacity of greater than about 5 g/g and has a water delivery of greater than about 4 g/g;

wherein the nonwoven web has an average pore volume of from about 5.3 ml/g to about 6.3 ml/g, has a pore area of from about 0.3 $m^2/g$ to about 0.4 $m^2/g$, and has a porosity of from about 80% to about 90%; and wherein the nonwoven web has a basis weight of from about 20 gsm to less than 90 gsm.

* * * * *